United States Patent [19]

Bull et al.

[11] Patent Number: 4,713,898

[45] Date of Patent: Dec. 22, 1987

[54] RAILROAD MOUNTED TRENCH DIGGER

[75] Inventors: Timothy B. H. Bull, Annandale; Raymond C. Wahl, Minnetonka, both of Minn.

[73] Assignee: Loram Maintenance of Way, Inc., Hamel, Minn.

[21] Appl. No.: 809,150

[22] Filed: Dec. 16, 1985

[51] Int. Cl.[4] ..... E02F 5/08; E02F 3/24

[52] U.S. Cl. ..... 37/96; 37/104; 37/190; 198/626

[58] Field of Search ..... 37/104–107, 37/84, 189, 190, 91–97; 171/16; 198/626; 144/2 N, 334

[56] References Cited

U.S. PATENT DOCUMENTS

| | | | |
|---|---|---|---|
| 1,564,784 | 12/1925 | Harris | 198/626 |
| 2,196,880 | 4/1940 | Van Voorhis et al. | 171/23 X |
| 2,257,351 | 9/1941 | Silver | 198/626 X |
| 2,696,375 | 12/1954 | Huff | 37/190 X |
| 3,314,175 | 4/1967 | Petty et al. | 37/190 X |
| 3,706,145 | 12/1972 | Bucksch et al. | 37/105 |
| 3,738,029 | 6/1973 | Harmon | 37/66 |
| 3,967,396 | 7/1976 | Maisonneuve et al. | 37/104 |
| 4,203,493 | 5/1980 | Miller | 171/16 |

FOREIGN PATENT DOCUMENTS

| | | | |
|---|---|---|---|
| 86050 | 8/1983 | European Pat. Off. | 37/84 |
| 3023075 | 2/1981 | Fed. Rep. of Germany | 37/91 |
| 767302 | 1/1957 | United Kingdom | 37/84 |
| 321601 | 1/1972 | U.S.S.R. | 37/189 |

OTHER PUBLICATIONS

One sheet entitled "The Drainmaker A Better Way From Marmon Transmotive", Marmon Transmotive, Knoxville, Tennessee 37901.

Article entitled "Good Drainage: An Oft-Forgotten Necessity", from Jan. 1985 issue of *Railway Track and Structures.*

Two page article entitled "Drainage . . . A Messy Job Under Control", from Aug. 1982 issue of *Progressive Railroading.*

*Primary Examiner*—Clifford D. Crowder

*Attorney, Agent, or Firm*—Dorsey & Whitney

[57] ABSTRACT

A trench digger for digging and maintaining drainage ditches along railway road beds. The trench digger includes a compact rotary drum cutting head mounted on a boom that can be swung about a boom base pivot axis to position the cutting head to either side of a railroad mounted support carriage. A first conveyor carries loosened composite from the cutting head to a first conveyor discharge point rearwardly of the boom base pivot axis. A second conveyor, pivotally mounted to the boom base at a second conveyor pivot axis oriented rearwardly of the boom base pivot axis, receives the loosened composite from the first conveyor and conveys the loosened composite to a second conveyor discharge point remote from the boom base.

7 Claims, 13 Drawing Figures

RAILROAD MOUNTED TRENCH DIGGER

TECHNICAL FIELD

This invention pertains to an apparatus for maintaining railway road beds. In particular, it pertains to equipment for digging drainage ditches along the side of railway road beds.

BACKGROUND ART

Railway road beds must be capable of supporting extremely heavy rolling stock. Railway road beds have traditionally included closely spaced railroad ties for supporting the railroad rails. The ties in turn are supported by ballast comprising debris free rocks through which rain water can quickly drain. It has long been recognized that drainage ditches running parallel to the railway road bed are necessary to carry away rain water that is drained from the railway road bed through the ballast.

The digging and maintenance of drainage ditches along a railway road bed can be a time-consuming process, and maintenance operations can obstruct portions of the railway to commercial rolling stock while the road bed is worked on. Rotary drum cutting heads have been used on machines for digging ditches or trenches along a railway road bed to increase the rate at which the ditch can be dug. Previous designs of rotary drum cutting heads, however, have required extremely large drums which must be mounted and used only on a given side of a railway mounted support carriage. Such ditch digging machines can dig a ditch only on one side of a railway road bed without transporting the support carriage to a turnabout area on the railway for reversing the orientation of the carriage on the railway.

SUMMARY OF THE INVENTION

The railroad mounted trench digger in accordance with the present invention comprises a specially designed, compact rotary drum cutting head mounted on a boom that is pivotally carried by a supporting railroad carriage. The boom can be swung to project from either side of the carriage to allow for the digging or maintenance of a ditch on either side of the railroad track road bed. The cutting head is compactly designed to reduce the weight at the end of the boom. The special design and arrangement of the cutting teeth on the rotary drum cutting head permit high speed rotation of the cutting head, thereby maximizing the digging capacity of the cutting head, notwithstanding its compact size.

BRIEF DESCRIPTION OF THE DRAWINGS

FIGS. 1*a* and 1*b* are to be joined;

FIGS. 2*a* and 2*b* are to be joined;

DETAILED DESCRIPTION OF THE DRAWINGS

Figure 1:
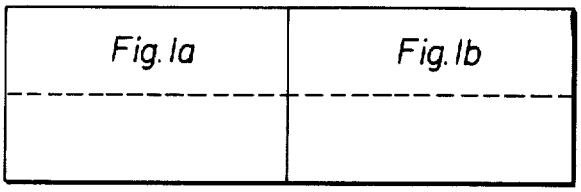
FIG. 1 comprising an organizational diagram showing how
Figure 2:
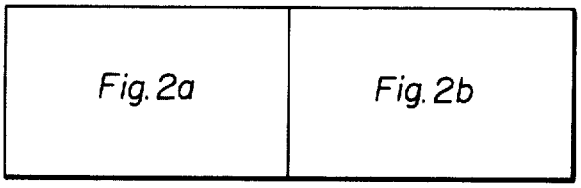
FIG. 2 comprising an organizational diagram depicting how

Referring to the drawings, the railroad mounted trench digger 20 in accordance with the present invention is depicted in FIGS. 1 and 2 in conjunction with conveyor car 22 and hopper car 24. The trench digger 20, conveyor car 22, and hopper car 24 are supported on the rails 26 of a railway road bed 28 by respective rail engaging wheels 30.

The trench digger broadly includes a carriage frame 32 supported on the rails 26 by wheels 30, operator booth 34, engine compartment 36, boom base 38, cutting head boom 40, and cutting head 42.

Boom base 38 comprises a generally circular stand 44 fixably attached to the carriage frame 32, and platform 46 pivotally carried by the stand 44. A pair of boom carrying stanchions 48, 50 extend upwardly from the platform 46. Boom counterweight 52 is attached to one side of platform 46. The lowermost portions of boom carrying stanchions 48, 50 each include clevis receiving ears 54, 56 respectively. Hydraulic piston and cylinder assemblies 58, 60 extend between clevis receiving ears 54, 56 and fittings 62, 64 respectively. The fittings 62, 64 are fixably carried by the carriage frame 32.

Cutting head boom 40 is pivotally coupled to boom base stanchions 48, 50 by trunnions 62, 64. The trunnions 62, 64 define a boom pivot axis that preferably intersects, or is located proximal to, the upright pivot axis defined by the rotatable boom base 38. The boom 40 comprises a top truss work 66 and opposed side truss works 68, 70 to define a truss frame work having an inverted U cross section. The rearwardmost frame member 72 of top truss work 66 includes a pair of clevis receiving fittings 74, 76. Boom elevation piston and cylinder assemblies 78, 80 are attached to fittings 74, 76 respectively. The piston and cylinder assemblies 78, 80 respectively extend between the fittings 74, 76 and boom base fittings 82, 84 carried by boom base platform 38. The cutter head boom 40 terminates at its forwardmost end with forward plate 86 and cutting head receiving clevis 88.

The cutting head 42 broadly includes rotatable cutting drum 90, drum support clevis 92, pivotal mounting bracket 94, shiftable front shroud 96, and chute 98. Mounting bracket 94 is received within the boom clevis 88, and pivotally retained therein by retaining pin 100. Cutting head rotation cylinders 102, 104 extend between boom forward plate 86 and drum mounting bracket 94. Cutting drum 90 can be stowed in a support stand 105 that is fixedly carried by carriage frame 32.

Figure 5:
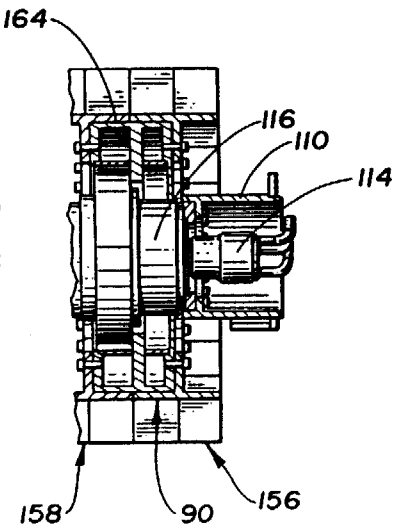
FIG. 5 is a fragmentary, sectional view taken along the line 5—5 of FIG. 4.

Drum support clevis 92 includes opposed support arms 106, 108. Drum support bearings 110, 112 are positioned at the lowermost end of clevis support arms 106, 108 respectively. Referring to FIG. 5, hydraulically actuated drum drive motor 114 is mounted within drum support bearing 110 and is connected to the cutting drum 90 through reduction gear box 116.

Shroud 96 is shiftably supported on clevis support arms 106, 108. The shroud 96 includes front plate 118 and opposed, similarly constructed side plates, only one side plate 120 being shown. The shroud side plates include opposed identical linear sleeves, only sleeve 124 of side plate 120 being shown, that are carried by opposed, identical cylindrical shroud bearing bars, only one bearing bar 128 being shown. The bearing bars are carried by clevis support arms 106, 108 respectively. Shroud elevation piston and cylinder assemblies 132, 134 are supported on fittings 136, 138 carried by clevis support arms 106, 108 respectively. The pistons of the piston and cylinder assemblies 132, 134 are connected to respective shroud side plates.

Chute 98 includes funnel portion 140, generally planar top plate 142, and pivotally mounted, arcuate front 144. Top plate 142 is fixably carried between clevis support arms 106, 108. Front plate 144 is pivotally coupled to fitting 146 of drum support clevis 92. Upstanding fitting 148 is attached to the top surface of front plate 144 and includes stop pin 150 abutable against clevis support arm 108. A leaf spring 152 is attached to support bar 154 extending between clevis support arms 106, 108. Leaf spring 152 abuts against chute front plate 144, urging the front plate 144 downwardly. The downward urging of the front plate 144 is limited by the abutment of stop pin 150 against clevis support arm 108.

Figure 3:
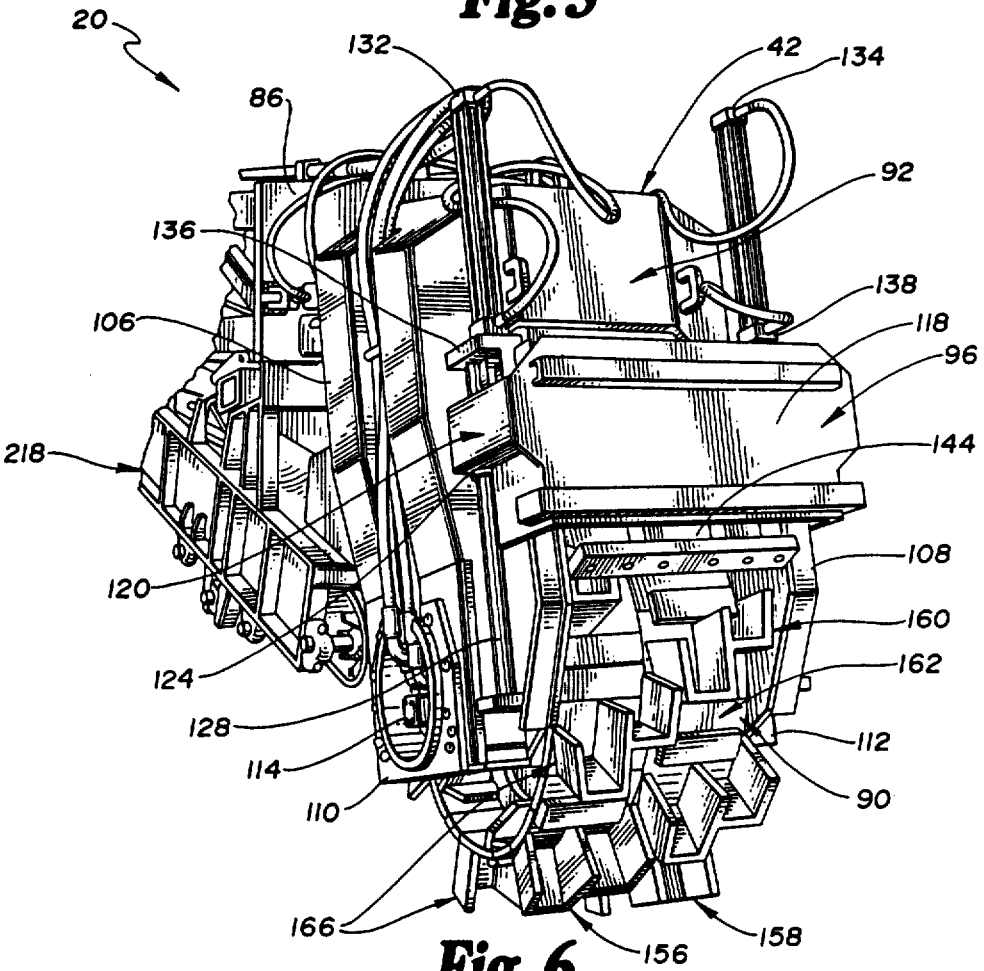
FIG. 3 is a fragmentary, perspective view depicting the digger cutting head.

Referring to FIG. 3, cutting drum 90 comprises a pair of side by side cutting drum halves 156, 158. Each cutting drum half 156, 158 comprises a plurality of alternating cutting bucket weldments 160 and bolster weldments 162 bolted to respective, axially opposed support sides of a centered cutting head hub comprising support wheel 164 (FIG. 5). The support wheel 164 is bolted onto the reduction gear box 116. Referring to FIG. 3, the two cutting drum halves 156, 158 are oriented with respect to each other such that the bucket weldments 160 define a plurality of circumferentially spaced helical cutting sections 166.

Figure 6:
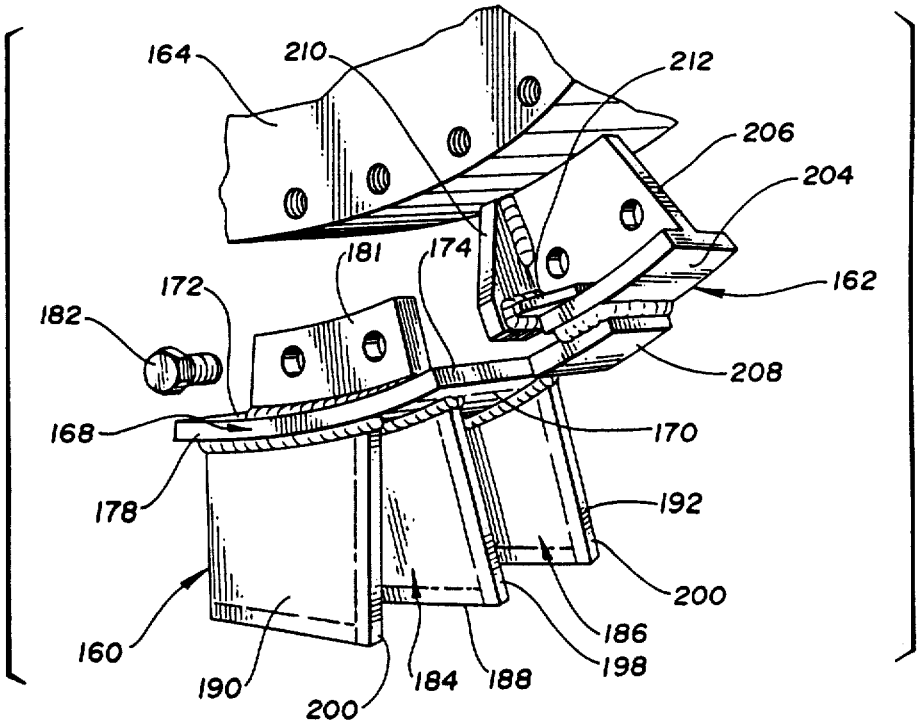
FIG. 6 is a fragmentary, enlarged, exploded view of the cutting head rotary drum.
Figure 1B:
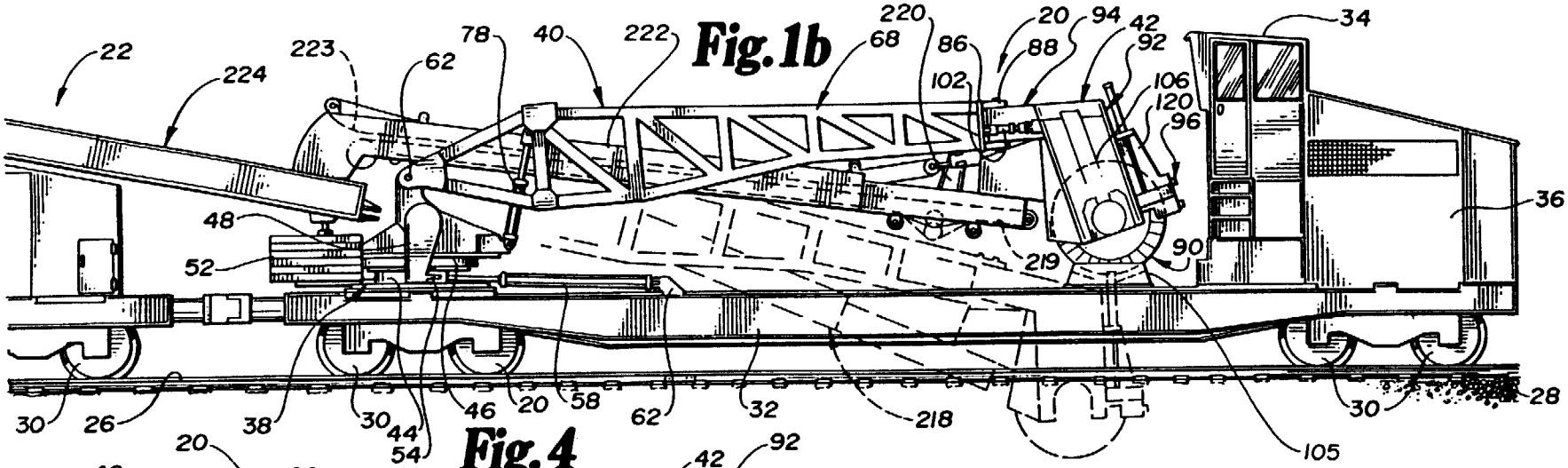
FIGS. 1*a* and 1*b* collectively comprise a side elevational view of a railroad mounted trench digger in accordance with the present invention in conjunction with a conveyor car and hopper car; phantom lines depicting the cutting head and cutting head boom in a digging orientation.
Figures 1A, 7, 8, 9, 9A, 10:
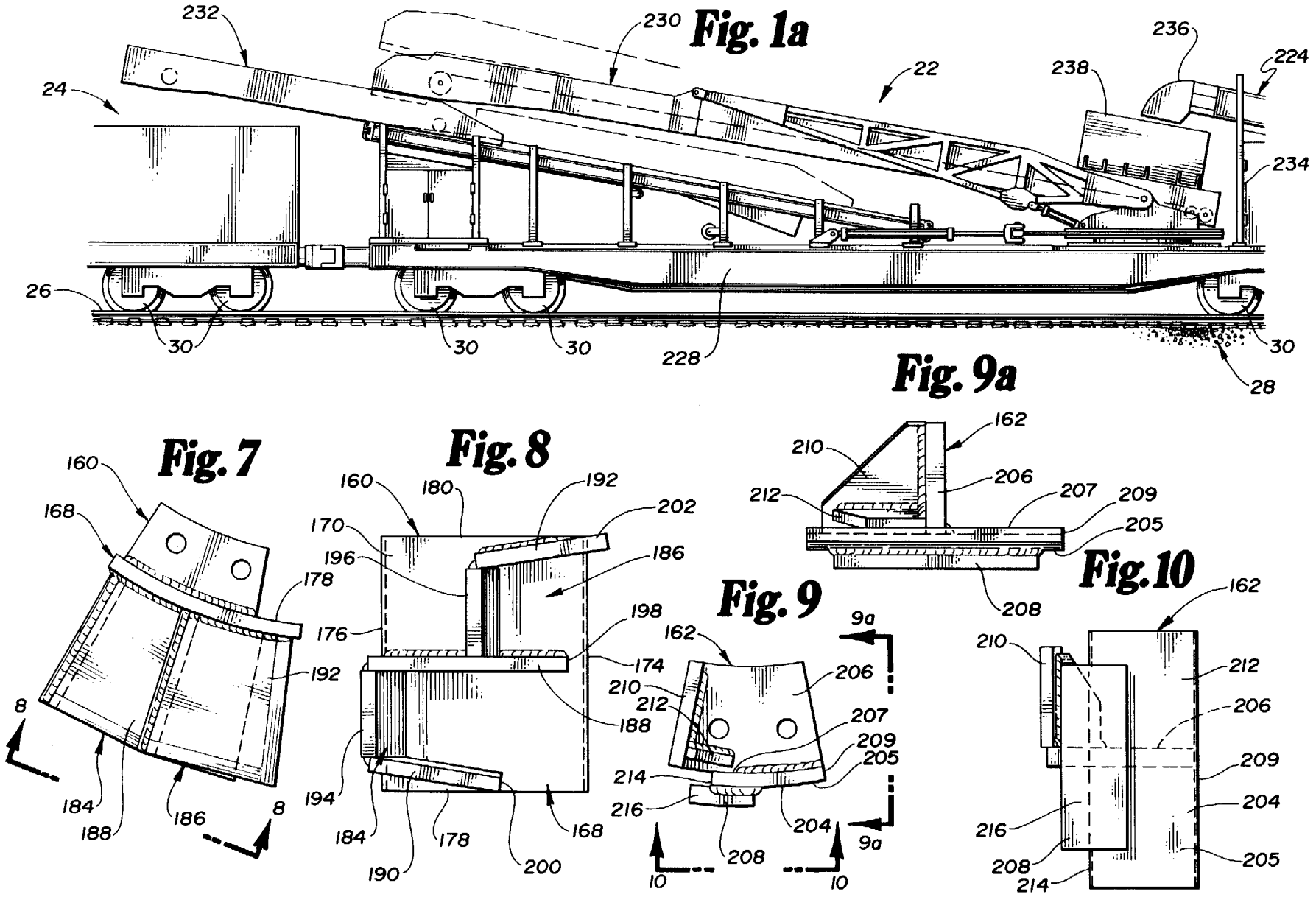
FIG. 7 is a side elevational view of a bucket weldment of the rotary drum.
FIG. 8 is a bottom view of a bucket weldment taken from the perspective of line 8—8 of FIG. 7.
FIG. 9 is a side elevational view of a bolster weldment of the rotary drum.
FIG. 9*a* is a front elevational view of a bolster weldment taken from the perspective of line 9*a*—9*a* of FIG. 9.
FIG. 10 is a bottom view of a bolster weldment taken from the perspective of line 10—10 of FIG. 9.

Referring in particular to FIGS. 6, 7 and 8, each bucket weldment 160 comprises a cutting sequence of drum 90 that includes an arcuate floor plate 168 having a convex outer surface 170, a concave inner surface 172, a leading margin 174, a trailing margin 176, and opposed side margins 178, 180. Attachment bracket 181 depends from convex inner surface 172, and couples the bucket weldment 160 to support wheel 164 via bolts 182. The floor plate leading margin 174 and trailing margin 176 are oriented generally parallel with the axis of rotation of the cutting drum 90 when the bucket weldment 100 is properly attached to support wheel 164.

Cutting buckets 184, 186 are defined on each bucket weldment 160 by center cutting plate 188, side cutting plates 190, 192 and bucket rear plates 194, 196. The center plate 188 and side plates 190, 192 each include leading cutting margins 198, 200, 202 respectively that, as is best seen in FIG. 8, are circumferentially and axially spaced apart from each other. Center plate 188 projects radially outwardly from the concave outer surface of floor plate 168, and is oriented generally perpendicular to the outer surface 170 and leading margin 174. Bucket defining side plates 190, 192 project generally radially outwardly from the concave outer surface 170 of floor plate 168, but, as is best depicted in FIG. 8, have their leading cutting margins 200, 202 flared slightly outwardly towards floor plate side margins 178, 180 respectively. Rear plates 194, 196 project outwardly from the concave outer surface 170 of floor plate 168, and interconnect the center plate 188 with side plates 190, 192 respectively. The rear plates 194, 196 are circumferentially and axially spaced apart, as is best depicted in FIG. 8.

Bolster weldments 162 comprise support segments of drum 90 that each include an arcuate bolster block mounting plate 204 having convex outer surface 205, concave inner surface 207, leading margin 209, attachment bracket 206, bolster block 208, and supporting gussets 210, 212. As best depicted in FIG. 9, bolster block 208 projects beyond the trailing margin 214 of mounting plate 204 to present a bucket weldment overlap portion 216.

Lift conveyor 218 includes shiftable endless web 219 and is suspended beneath boom 40 by brackets 220. The lift conveyor 218 extends upwardly from chute 98 to a point above and past the pivot axis of boom base 38. Cover conveyor 222 includes shiftable endless web 223 and is positioned immediately above lift conveyor 218. The cover conveyor 222 runs substantially along the length of the lift conveyor 218.

Jump conveyor 224 includes shiftable endless web 225, and is pivotally mounted on top of counter weight 52. Jump conveyor 224 extends upwardly from a point below the uppermost end of lift conveyor 218 to a point extending beyond the end of the trench digger carriage frame 32, such that it can extend over conveyor car 22.

Figure 2A:
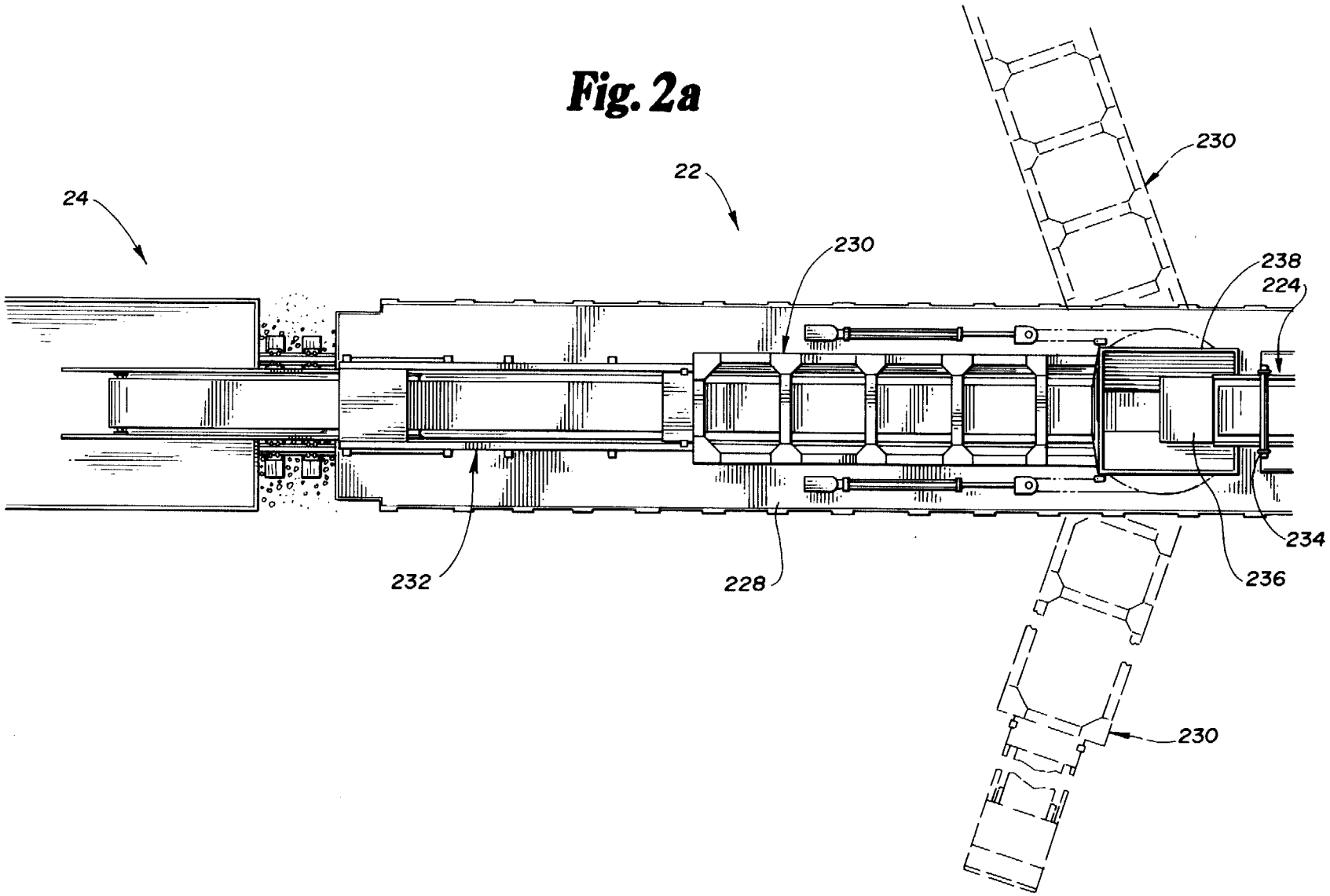
FIGS. 2*a* and 2*b* collectively comprise a plan view of the railroad mounted trench digger in accordance with the present invention in conjunction with a conveyor car and a hopper car, phantom lines depicting the cutter head and cutter head boom in alternative digging orientations, and the swing conveyor in alternative discharge orientations.
Figure 2B:
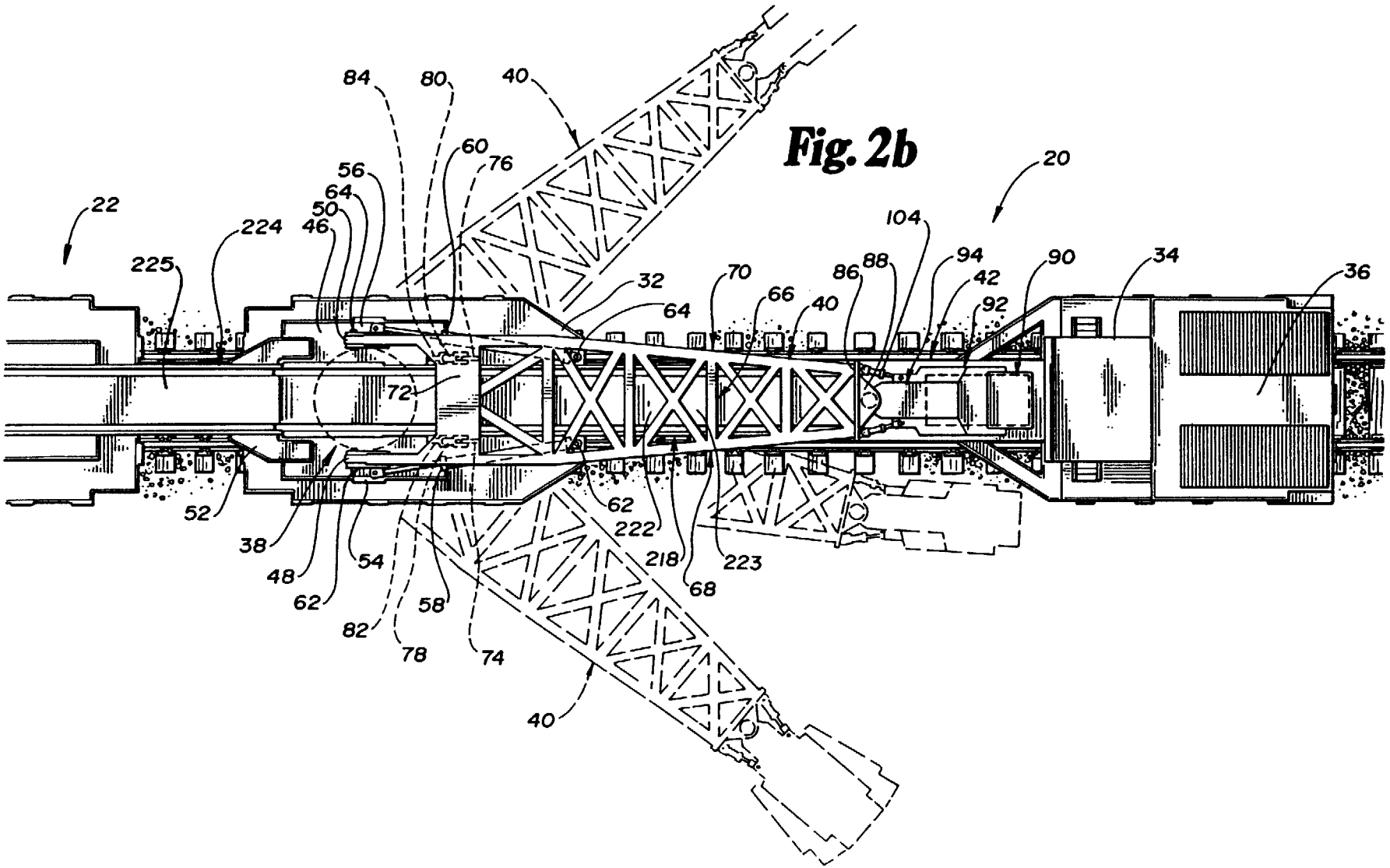

Conveyor car 22 includes conveyor car carriage 228, swing conveyor 230, and shuttle conveyor 232. Jump conveyor support 234 positions the discharge end 236 of jump conveyor 224 over conveyor hopper 238. Swing conveyor 230 is pivotally mounted on the conveyor car carriage 228, and, as is depicted in FIG. 2*a*, can be swung to either side of the conveyor car 22. Shuttle conveyor 232 is positioned below swing conveyor 230, and extends beyond conveyor car 22 to be positioned over hopper car 24.

In operation, trench digger 20, conveyor car 22, and hopper car 24 are transported to a selected portion of a railroad road bed by an independent locomotive (not shown). Trenching operations are commenced by extending the boom elevation piston and cylinder assemblies 78, 80 to lift the boom 40 and take the cutting drum 90 out of the drum support stand 105. The boom 40 can then be swung to the left of carriage 32 by extending boom swing cylinder 58 and retracting boom swing cylinder 60, or can be positioned to the right of the carriage 32 by extending boom swing cylinder 60 and retracting boom swing cylinder 58. The trench digger 20 is the lead car, and the hopper car 24 the trailing car, when the trench digger 20 is operated in the forward direction. The boom 40 can be swung as far as 41 degrees to either side of the carriage 32, depending on how far from the railroad track 26 and road bed 28 it is desired to dig a trench. Digging operations can commence when the boom 40 is lowered to position the cutting drum 90 on the surface of the ground next to the road bed 28.

Figure 11:
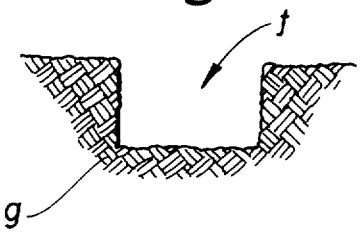
FIG. 11 is a sectional view of a trench profile formed by the rotary drum of the cutting head when the axis of rotation of the drum is generally perpendicular to the railway road bed.
Figure 12:
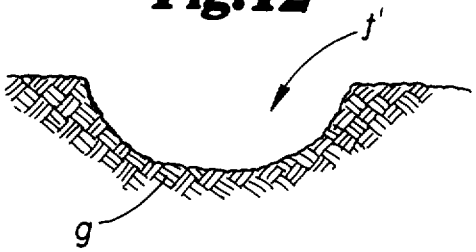
FIG. 12 is a sectional view of a trench profile formed by the rotary drum of the cutting head when the axis of rotation of the drum is not perpendicular to the railway road bed.

Referring to FIGS. 11 and 12, the cross sectional profile of a trench t can be rectangular, as in FIG. 11, or arcuate (t'), as in FIG. 12. In particular, the profile of the trench t can be determined by actuating the cutting head rotation piston and cylinder assemblies 102, 104 to pivot the cutting head 42 about pivot pin 100, thereby orienting the axis of rotation of cutting drum 90 relative to the rail 26 and road bed 28. Orientation of the cutting drum 90 axis of rotation perpendicular to the rails 26 and road bed 28 results in the trench having a generally rectangular cross sectional profile (FIG. 11). Orientation of the cutting drum axis of rotation at angles other than perpendicular to the rails 26 and road bed 28 results in an arcuate trench cross sectional profile (FIG. 12). The profile of the trench t will be frusto-eliptical, approaching frusto-circular, as the angle of the axis of rotation of the cutting drum 90 is varied from perpendicular orientation to the rails 26.

Rotation of the cutting drum 90 causes the leading cutting edges 198, 200, 202 of each of the center and side plates 188, 190, 192 of each bucket weldment 160 to cut into the ground g. Although several leading cutting edges 198, 200, 202 may be on the ground at any given time, only one cutting edge will penetrate the surface of the ground at a time, because of the circumferential spacing of the cutting edges. The cutting action of the bucket edges loosens the ground into a disturbed composite that is captured within the cutting buckets 184, 186 of the bucket weldments 160.

Cutting contact of the bucket weldments 160 with the ground g presents a pivoting force to the bucket weldment 160. Bolster plates 208 of bolster weldments 162 counteract the pivoting force by overlapping the leading margins 174 of the respective buckets weldments 160, and retaining the leading margins 174 in their proper place.

Figure 4:
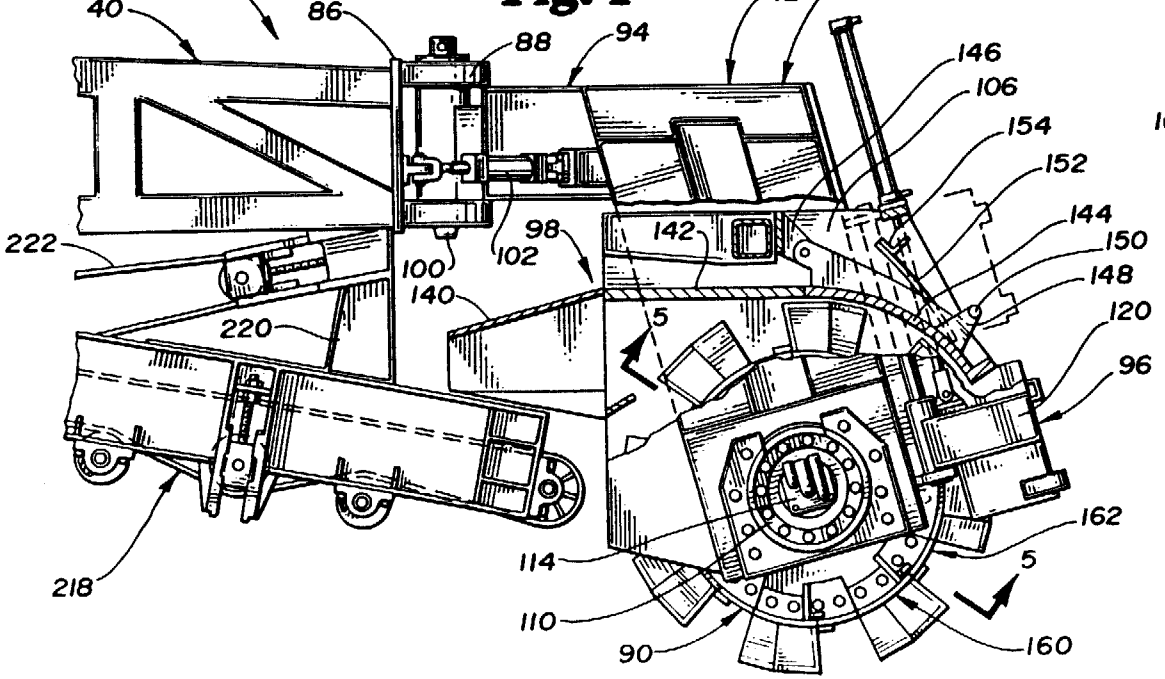
FIG. 4 is a fragmentary, side elevational view depicting the cutting head with parts removed for clarity.

The normal, counterclockwise rotation of the cutting drum 90 (as seen from the perspective of the figures) carries the loosened composite within the buckets 184, 186 into the chute 98 of the cutting head 42. The shroud 96 will, for normal trenching operations, be in its lowermost position, as depicted in FIG. 4. The shroud 96, when placed in its lowermost position, acts as a shield to prevent the loosened composite from being thrown from the cutting head 42, and directs the loosened composite into the chute 98.

It is not unusual to uncover large rocks during trenching operations. Accordingly, arcuate front plate 144 is designed to pivot upwardly, against the biasing force of leaf spring 152, in the event a large rock is uncovered, and carried into the chute 98. The arcuate front plate 144 is normally maintained in a position just slightly spaced from the rotating bucket weldments 160 so as to capture the loosened composite in the chute 98. Rotation of the bucket weldments 160 through the chute 98 urges the loosened composite through the chute 98. Loosened composites exits the chute 98 through funnel 140, and is deposited on the lift conveyor 218. The loosened composite is pressed between the lift conveyor 218 and cover conveyor 222, and is urged upwardly by the combined action of the lift conveyor 218 and cover conveyor 222.

Counterweight 52 is fixably positioned on boom platform 38, directly opposite the boom 40, and swings outwardly from the carriage frame 32 in a direction opposite to the boom 40, when the boom 40 is positioned to one side or the other of the carriage frame 32. Jump conveyor 224 is pivotally mounted on the counterweight 52 at its lowermost end, and is held in place at its uppermost end by the conveyor support 234. The lowermost end of the jump conveyor 224, therefore, will always be positioned underneath the uppermost end of the lift conveyor 218, and the uppermost end of the jump conveyor will be positioned over the swing conveyor hopper 238 of conveyor car 22, independent of the side to side position of the boom 40. Loosened composite that is discharged from the lift conveyor 218 falls onto the jump conveyor 224 and is conveyed into the swing conveyor hooper 238.

As is best depicted in FIG. 2a, the swing conveyor 230 can be centered along the conveyor car frame 228, or swung to either side of the conveyor car frame 228. Loosened composite is transferred from the swing conveyor hopper 238 upwardly along the swing conveyor 230, and deposited to one side or the other of the road bed 28, or onto shuttle conveyor 232. Shuttle conveyor 232 conveys the loosened composite into hopper car 24 for transportation of the loosened composite to a distant location.

The trench digger 20 in accordance with the present invention can also be used to terrace terrain that is close to, but elevated above, railway road bed 28. Shroud 96, when in its lowered position, would obstruct contact of the leading cutting edges 98, 200, 202 of the bucket plates when attempting to terrace ground elevated above the railway road bed 28. Shroud 96, therefore, can be shifted to a raised position, as depicted in FIG. 3, clearing the cutting drum 90 to expose the leading cutting edges 198, 200, 202 of the bucket plates at a higher point relative to the cutting drum axis of rotation.

I claim:

1. A railroad mounted trenching apparatus for digging a ditch in the ground along a road bed for a railway, comprising:

a carriage having opposed sides and including rail engaging wheels for mounting said carriage on a railway;

a boom base rotatably carried by said carriage at a generally upright boom base pivot axis;

a cutting head support boom pivotably carried by said boom base;

a cutting head for disturbing said ground into a loosened composite, operably carried by said support boom forwardly of said boom base pivot axis;

first power means operably coupled to said support boom for pivoting said support boom about said boom base between raised and lowered positions;

second power means operably coupled to said boom base for rotating said boom base about said generally upright boom base pivot axis;

first conveyor means extending along said cutting head support boom for conveying said loosed composite from said cutting head to a first conveyor means discharge end rearwardly of said boom base pivot axis;

second conveyor means pivotally carried by said boom base at a generally upright second conveyor means pivot axis oriented rearwardly of said boom base pivot axis, said second conveyor means including a second conveyor means discharge end rearwardly of said second conveyor means pivot axis and a second conveyor means receiving end oriented forwardly of said second conveyor means pivot axis below said first conveyor means discharge end, whereby said support boom and said first conveyor means clears said second conveyor means when said cutting head is rotated about said boom base pivot axis for positioning said cutting head on either side of said carriage, and said second conveyor discharge end remains substantially stationary relative to said carriage as said cutting head is shifted from side to side of said carriage.

2. A trenching apparatus as claimed in claim 1, said cutting head including a rotary cutting drum having a cutting drum axis of rotation, said cutting head being pivotally coupled to said support boom, and said apparatus including third power means for pivoting said cutter head about said support boom, whereby said drum axis can be selectively oriented relative to said railway road bed for selectively altering the cross sectional profile of the ditch dug by said trenching apparatus.

3. A trenching apparatus as claimed in claim 2, said cutting drum presenting a generally cylindrical cutting surface, said trench cross sectional profile being generally rectangular when said drum axis of rotation is oriented perpendicular to said railway road bed, and said cross sectional profile being frusto-eliptical when said drum axis of rotation is oriented at angles other than perpendicular to said railway road bed.

4. A trenching apparatus as claimed in claim 1, said first conveyor means including a first, shiftable, endless web extending from said cutting head substantially along the length of said support boom and a second, shiftable, endless web spaced apart and positioned above said first web, whereby loosened composite is received between said first and second webs from said cutting head and transported along the length of said support boom by said first and second webs.

5. A trenching apparatus as claimed in claim 1, said cutting head including a rotary cutting drum having a generally cylindrical cutting surface, and chute means for directing said loosened composite from said cutting drum to said first conveyor means, said chute means including an arcuate plate pivotally coupled to said cutting head and cover plate biasing means for urging said cover plate into spaced apart, proximal relationship with said cutting drum, whereby loosed composite is retained between said cutting drum and said cover plate, and said cover plate can be shifted away from said proximal relationship with said cutting drum, against the urging of said cover plate biasing means for passage of oversized elements of said loosened composite through said funnel means.

6. A trenching apparatus as claimed in claim 1, including a cutting drum having a cutting surface mounted on said cutting head for rotation of said cutting surface in a generally circular cutting path of travel, a cutting drum shroud shiftably mounted on said cutting head and oriented generally along a tangent plane to said circular cutting path of travel, and means operably coupled to said shroud for shifting said shroud along said tangent plane between a first, raised position clearing said cutting drum and a second, lowered position covering a portion of said cutting drum whereby the cutting surface of said cutting drum is exposed for cutting engagement with ground elevated above said road bed when said shroud is in said first position.

7. A railroad mounted trenching apparatus for digging a ditch in the ground along a road bed for a railway, comprising:

a carriage having opposed sides and including rail engaging wheels for mounting said carriage on a railway;

a boom base rotatably carried by said carriage;

a cutting head support boom pivotally carried by said boom base;

a cutting head operably carried by said support boom;

first power means operably coupled to said support boom for pivoting said support boom about said boom base between raised and lowered positions; and second power means operably coupled to said boom base for rotating said boom base relative to said carriage;

a cutting drum having a cutting surface operably carried by said cutting head for rotation of said cutting surface in a generally circular cutting path of travel;

a cutting drum shroud shiftably mounted on said cutting head and oriented generally along a tangent plane to said circular cutting path of travel, and means operably coupled to said shroud for shifting said shroud along said tangent plane between a first, raised position clearing said cutting drum and a second, lowered position covering a portion of said cutting drum whereby the cutting surface of said cutting drum is exposed for cutting engagement with ground elevated above said road bed when said shroud is in said first position.

* * * * *

UNITED STATES PATENT AND TRADEMARK OFFICE

CERTIFICATE OF CORRECTION

PATENT NO. : 4,713,898

DATED : December 22, 1987

INVENTOR(S) : Timothy Bad Heart Bull and Raymond C. Wahl

It is certified that error appears in the above-identified patent and that said Letters Patent is hereby corrected as shown below:

Column 4, line 1, delete the number "100" and substitute therefor --160--.

Column 4, line 59, delete the word "railroad" and substitute therefor --railway--.

Column 5, line 66, delete the word "composites" and substitute therefor --composite--.

Column 6, line 20, delete the word "hooper" and substitute therefor --hopper--.

Column 6, line 35, delete the number "98" and substitute therefor --198--.

Signed and Sealed this

Fifth Day of July, 1988

*Attest:*

*Attesting Officer*

DONALD J. QUIGG

*Commissioner of Patents and Trademarks*